US006695534B2

(12) United States Patent
Cain et al.

(10) Patent No.: US 6,695,534 B2
(45) Date of Patent: Feb. 24, 2004

(54) FLUID CONTAINMENT SYSTEM

(75) Inventors: Thomas Cain, Drayton Valley (CA); Alex Lambert, Drayton Valley (CA)

(73) Assignee: DC Equipment Corporation, Drayton Valley (CA)

( * ) Notice: Subject to any disclaimer, the term of this patent is extended or adjusted under 35 U.S.C. 154(b) by 0 days.

(21) Appl. No.: 10/114,271

(22) Filed: Apr. 3, 2002

(65) Prior Publication Data

US 2003/0190192 A1 Oct. 9, 2003

(51) Int. Cl.[7] ..... E02B 7/00; B65D 90/24; B65D 90/08

(52) U.S. Cl. ..... 405/52; 405/114; 52/102

(58) Field of Search ..... 405/114, 52; 52/102

(56) References Cited

U.S. PATENT DOCUMENTS

| | | | | | |
|---|---|---|---|---|---|
| 3,959,830 | A | * | 6/1976 | van den Broek | 52/287.1 |
| 4,632,602 | A | * | 12/1986 | Hovnanian | 405/129.8 |
| 4,678,368 | A | * | 7/1987 | Helversen | 405/118 |
| 4,765,775 | A | | 8/1988 | Kroger | |
| 4,946,306 | A | | 8/1990 | Yodock | |
| 5,114,274 | A | * | 5/1992 | Heiler, Jr. | 405/129.7 |
| 5,123,773 | A | | 6/1992 | Yodock | |
| 5,371,988 | A | * | 12/1994 | Hannes | 52/282.1 |
| 5,545,195 | A | | 8/1996 | Lennox et al. | |
| D385,362 | S | | 10/1997 | Rossetti | |
| 5,689,920 | A | | 11/1997 | Hallsten | |
| 5,706,620 | A | * | 1/1998 | De Zen | 52/220.2 |
| 5,735,090 | A | * | 4/1998 | Papke | 52/220.2 |
| 5,882,142 | A | * | 3/1999 | Siglin et al. | 405/52 |
| 5,967,701 | A | * | 10/1999 | Berkley et al. | 405/281 |
| D431,082 | S | | 9/2000 | Jaros | |
| 6,151,835 | A | * | 11/2000 | Hallsten | 52/5 |
| 6,493,997 | B2 | * | 12/2002 | Cohen | 52/79.9 |

* cited by examiner

*Primary Examiner*—Robert J. Sandy
*Assistant Examiner*—Katherine Mitchell
(74) *Attorney, Agent, or Firm*—Ryan W. Dupuis; Adrian D. Battison; Michael R. Williams

(57) ABSTRACT

The fluid containment system comprises a plurality of interlocking wall sections, each having a male connector at one end and a mating female connector at an opposite end for connection to the male connector of an adjacent wall section in alignment therewith having a similar configuration. A plurality of connector sections are also provided which connect the wall sections at right angles to one another for forming a perimeter about a selected area to contain spilled fluid within the selected area. A liner is provided which spans the selected area and is secured to the wall sections about the perimeter of the selected area by a suitable capping system. The connector sections permit the selected area to be divided by the wall sections into plural divided and contained zones for protecting various different fluid storage systems within the selected area against undesirable spillage and possible mixing with one another.

20 Claims, 5 Drawing Sheets

FLUID CONTAINMENT SYSTEM

FIELD OF THE INVENTION

The present invention relates to a fluid containment system and more particularly to a dyking system for use as a secondary fluid containment system surrounding a primary fluid storage device.

BACKGROUND

The use of portable dyking systems are known in various situations for containing fluid within a prescribed area. Known systems include plural sections which can be interconnected to form elongate wall structures.

Examples of dyking and containment systems are found in the following U.S. Pat. Nos. 5,689,920 and 5,454,195 both to Hallsten, U.S. Pat. Nos. 5,123,773 and 4,946,306 both to Yodock, U.S. Pat. No. 4,765,775 to Kroger, D385, 362 to Rossetti and D431,082 to Jaros. The systems of Rossetti, Jaros and Yodock however are not suitably arranged for interconnection about a confined area. While the systems of Hallsten, and Kroger can enclose a prescribed area, none of the systems are sufficiently versatile to enclose a prescribed area and subdivide the area into plural zones or cells when it is desirable to separately contain two or more zones within the area.

SUMMARY

According to one aspect of the present invention there is provided a fluid containment system comprising:

- a plurality of wall sections, each spanning between a respective male end having a male connector projecting therefrom and a respective female end having a female connector arranged to receive the male connector of an adjacent wall section having a similar configuration therein;
- a plurality of connector sections being arranged to connect the wall sections about a perimeter of a selected area;
- a liner arranged to span the selected area; and
- a mounting mechanism arranged to secure the liner to the wall sections about the perimeter of the selected area.

The connector sections according to the present invention permit the wall sections to be assembled in numerous configurations, including perimeter wall sections and intermediate wall sections which separately contain more than one zone within the area. When the connector sections have a square base with two, three or four possible wall connections, minimal space is occupied while maximum versatility for containing fluid about multiple fluid storage devices is achieved.

Each wall section and each connector section is preferably hollow and includes an access port permitting the wall section to be filled with material.

The mounting mechanism may comprise a plurality of cap members arranged to span a top side of the wall sections and a plurality of fasteners arranged to secure the cap members to the wall sections with the liner being secured between the cap members and the top side of the wall sections.

Both the cap members and the top sides of the wall sections preferably include respective apertures therein for receiving the fasteners therethrough.

In one embodiment, the fasteners each include a threaded portion arranged for securement to the top side of the wall sections and a head portion which lies in a substantially common plane with a longitudinal axis of the threaded portion. The apertures in the cap members in this instance each comprise an elongate slot arranged to receive the head portion of the respective fastener therethrough in a first position of the fastener while restricting passage of the head portion therethrough in a second position of the fastener in which the head portion is rotated at right angles relative to the first portion.

Each male connector preferably includes a narrow neck portion and a main portion of increased dimension. Accordingly, each female connector includes a narrow mouth portion and a main portion of increased internal dimension for mating with the neck portion and main portion of a respective male connector in an interlocking configuration.

The connector sections are preferably arranged to connect the wall sections about the perimeter of the area as well as connecting intermediate wall sections between wall sections on opposing sides of the perimeter of the area for dividing the area into a plurality of zones each surrounded by the wall sections.

Each of the connector sections preferably has a square base with dimensions approximately equal to a width of the wall sections.

Each connector section preferably has a plurality of sides in which at least one of the sides includes a male connector projecting therefrom which is arranged to be received with the female connector of one of the wall sections and at least one of the sides includes a female connector arranged to receive the male connector of one of the wall sections therein.

At least one of the connector sections preferably comprises a corner section having a male connector on one side and a female connector on another side thereof.

The corner section preferably has a square base with the male connector and female connector being located on adjacent sides of the square base.

A pair of handles are preferably located on adjacent sides of the corner section opposite the male connector and female connector respectively.

At least one of the connector sections may comprise a 4-way section having a square base and having either a male connector or a female connector on each side thereof.

The 4-way section preferably includes two male connectors on adjacent sides and two female connectors on adjacent sides opposite the two male connectors respectively.

At least one of the connector sections may also comprise a 3-way section having a male connector and a female connector on opposite sides and a second male connector on an intermediate side between the opposed male and female connectors. Alternatively, the 3-way section may have a male connector and a female connector on opposite sides and a second female connector on an intermediate side between the opposed male and female connectors.

When each of the connector sections has a square base, preferably at least one of the connector sections is a spacer section having a male connector and a female connector on opposite sides of the spacer section.

The wall sections and connector sections are preferably formed of plastic material having an ultraviolet resistant additive.

BRIEF DESCRIPTION OF THE DRAWINGS

In the accompanying drawings, which illustrate an exemplary embodiment of the present invention.

DETAILED DESCRIPTION

Figure 1:
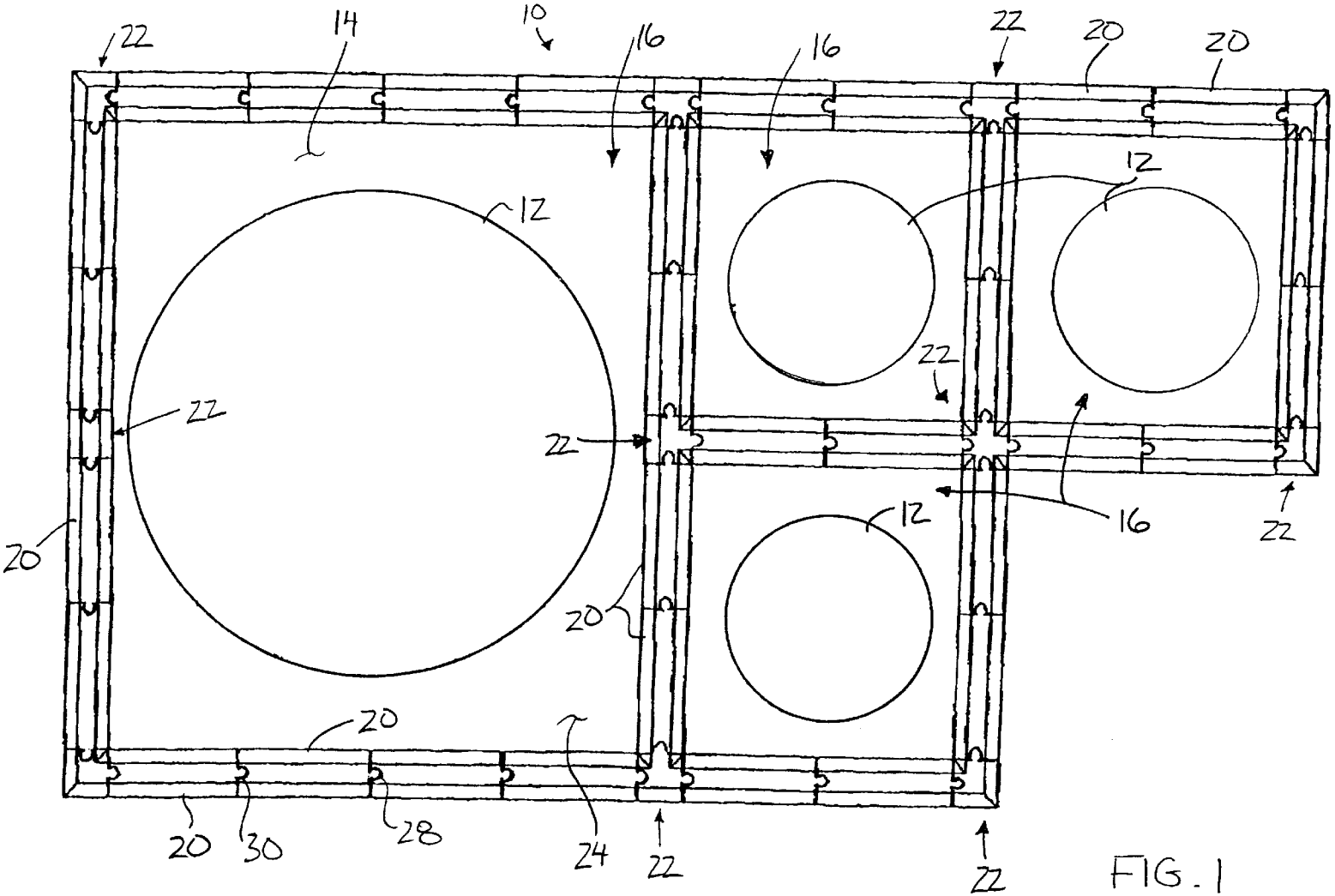
FIG. 1 is a top plan view of the fluid containment system.
Figure 3:
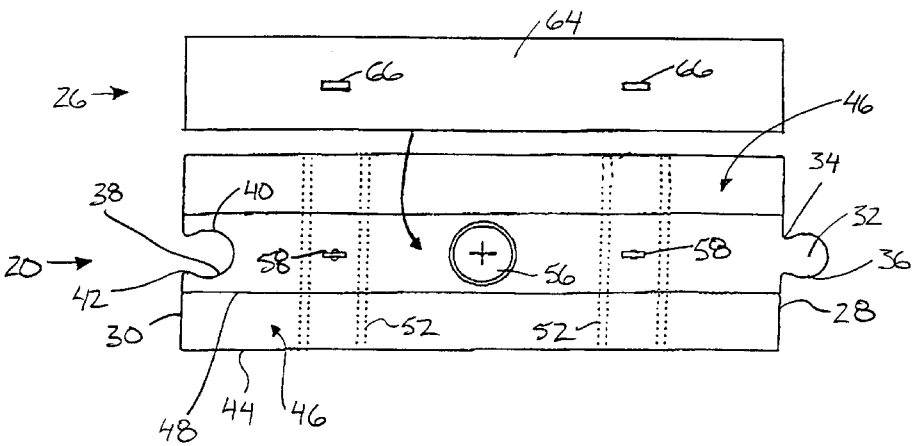
FIG. 3 is a top plan view of the wall section.
Figure 2:
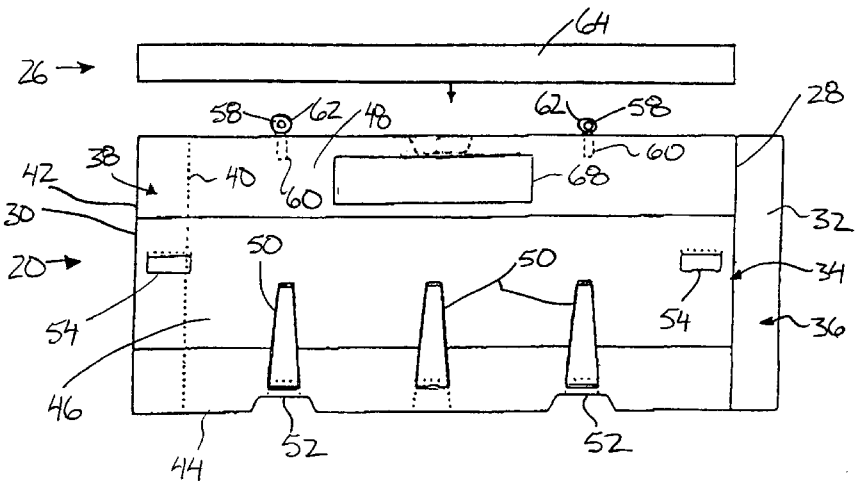
FIG. 2 is a side elevational view of a wall section.
Figure 4:
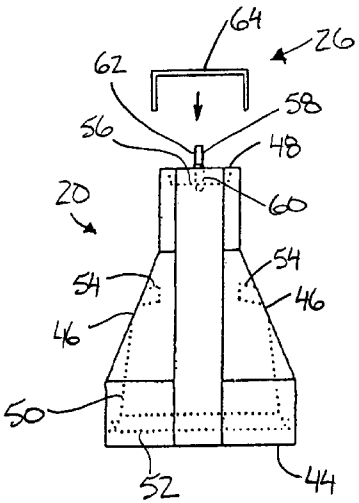
FIG. 4 is an end view of the wall section.
Figure 8:
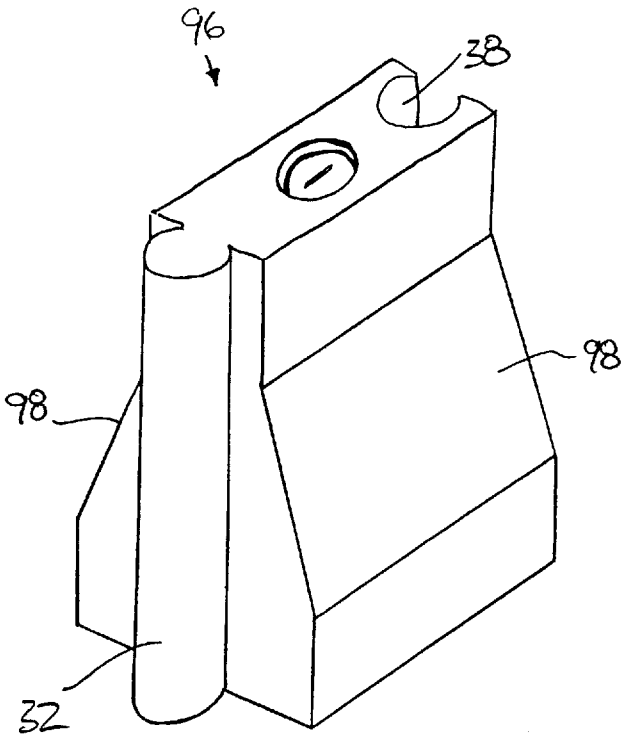
FIG. 8 is an isometric view of a spacer section.

Referring to the accompanying drawings, there is illustrated a containment system generally indicated by reference numeral 10. More particularly the containment system 10 comprises dyking for secondary containment of spilled fluid within a prescribed area about a primary fluid storage device 12. When more than one storage device 12 is located within a prescribed area 14 the area may be divided into plural zones 16 which are subdivided by the containment system 10 to prevent any mixing of the fluids of the various storage devices 12 in the event that one or more of the devices spilled fluid.

The system generally includes a plurality of elongate wall sections 20 which are arranged to be interconnected in alignment with one another to form a wall structure. A plurality of square connector sections 22 are provided for interconnecting assembled wall sections 20 together in alignment with one another or perpendicular to one another so that the wall sections 20 may be enclosed about a perimeter of the prescribed area 14 as well as spanning across the prescribed area for dividing the zones 16 of the area. In addition to the wall sections 20 and the corner sections 22, a liner 24 is provided for spanning the prescribed area 14 and for securement to the wall sections about the perimeter of the prescribed area by a suitable capping system 26.

Each of the sections 20 and 22 comprises a hollow container molded of plastic material, preferably high density polyethylene. An ultraviolet resistant additive may be included in the material forming the sections to resist degradation of the plastic in ultraviolet light. Each of the sections is arranged for containing liquid therein for added weight and stability of the containment system when the sections are filled with water or some other suitable material.

Each wall section 20 is arranged to span between a male end 28 and a female end 30. The male end 28 includes a male connector 32 in the form of a vertically oriented bead of circular cross section which extends the full height of the wall section at the male end 28. The connector 32 is mounted on the male end at a narrow neck portion 34 so that the main portion 36 has an enlarged lateral dimension in relation to the neck portion.

Accordingly the female end 30 includes a female connector 38 which is similarly vertically oriented to extend a full length of the female end 30 of the wall section. The female connector 38 is a receptacle which is suitably sized to receive the male connector 32 of an adjacent section having a similar configuration. A main portion 40 of the receptacle of the female connector 38 is generally circular in cross section for receiving the main portion of the male connector slidably in a vertical direction therein. The female connector 38 further includes a narrow mouth portion 42 which is reduced in lateral dimension similarly to the neck portion of the male connector for restricting removal of the main portion of the male connector from the main portion of the female connector 38 when the male connector is vertically and slidably received within the female connector in an interlocked position.

The main body of each wall section 20 includes a wide base 44 from which the sides 46 of the wall section extend vertically upward therefrom at a first portion adjacent the base before tapering inwardly through a main central portion of the wall section to a narrower top section which spans vertically upward to the top 48 of the wall section.

Ribs 50 are molded into the sides 46 of each wall section at longitudinally spaced positions therealong for added structural stability. The base 44 of each wall section 20 further includes a plurality of channels 52 formed therein which span laterally between opposing sides of the wall section for added structural stability and to permit access for the forks of a forklift thereunder for handling if desired.

Each wall section further includes a set of four handles 54 which are similarly molded into the sides 46 of the wall section. A pair of the handles 54 are located in each side 46 of the wall section at opposite ends of the wall section spaced between the top and base thereof. Each handle 54 generally comprises an indent formed into the sides 46 of the wall section for defining a horizontal shelf extending inwardly which is suitably sized for gripping with a person's hand.

The top 48 of the wall section is generally flat, spanning horizontally between respective ends of the wall section. A central fill port 56 is located in the top 40 of the wall section between respective ends thereof for permitting access for materials to be filled into the wall section.

The top of the wall section 20 further includes a pair of fasteners 58 at longitudinally spaced positions between respective ends of the wall section. Each fastener 58 includes a threaded portion which is secured to the top of the wall section and a corresponding head portion 62 which projects upwardly therefrom for securing a cap member 64 to the top of the wall section. The head portion 62 of each fastener is arranged to lie generally flat in a common plane with, or at least parallel to, a longitudinal axis of the threaded portion 60 of the fastener. The flat nature of the head portion 62 permits insertion thereof through respective slots 66 in the cap member.

The cap member is an elongate channel having a generally U-shaped cross section which is suitably sized for fitting over the top 48 and down along both sides 46 adjacent the top of each wall section. Suitable clearance between the internal dimensions of the cap member 64 and the top of the wall section 20 is provided for accommodating the thickness of the liner 24 which may be secured therebetween.

The slots 66 are positioned at longitudinally spaced positions between respective ends of the cap member in alignment with the position of the fasteners 58 on the top side of the wall sections. The slots 66 are each elongate and narrow for receiving the head portion 62 of the respective fasteners 58 therethrough in a first position of the fasteners when the plane of the head portion 62 is aligned with the longitudinal direction of the slots 66.

Once the cap is secured on top of the wall section with the liner secured between the wall section and the cap member and fasteners having been extended through the slots 66, the fasteners may be rotated approximately 90° into a second locked position in which the plane of the head portion 62 lies transversely to the longitudinal direction of the slots 66 for restricting removal of the cap member 64 from the wall section, thereby securing the liner 24 in place against the top side of the wall section.

The wall section 20 may further include a name plate 68 with suitable identifiable markings molded into the side 46 of the wall section.

Figure 6:
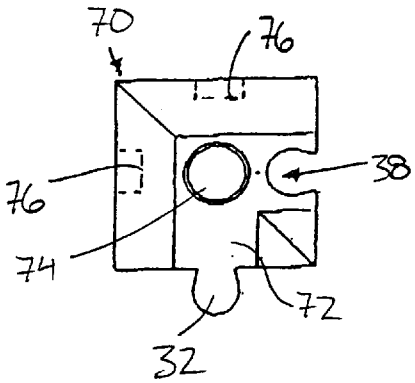
FIG. 6 is a top plan view of the corner section.
Figure 7:
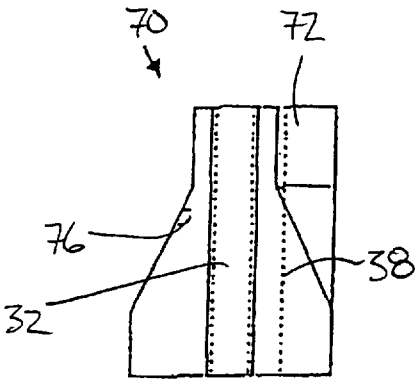
FIG. 7 is a side elevational view of the corner section.
Figure 5:
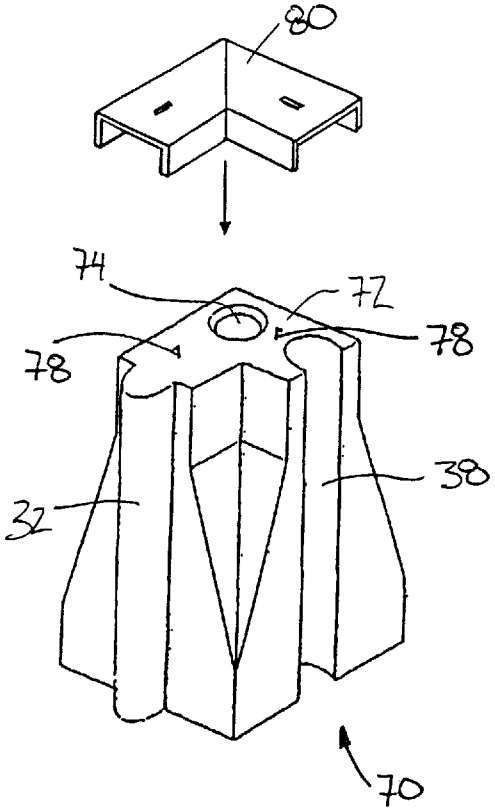
FIG. 5 is an isometric view of a corner section.

As shown in FIG. 1 some of the connector sections 22 comprise corner sections 70. Each corner section 70, shown in further detail in FIGS. 5 through 7, has a square base having dimensions which are equal to the width of the base 44 of each wall section 20. Each corner section is arranged to connect two wall section 20 at right angles to one another for defining a rectangular perimeter about the prescribed area. Similarly to the wall section 50, the corner section 70 tapers inwardly towards a narrow top section 72 which extends between the male connector 32 located on one side of the corner section and the female connector 38 located on an adjacent side of the corner section.

The two adjacent sides of the corner section mounting the corresponding male and female connectors thereon are vertically oriented with the connectors spanning the full height of the corner section for suitably connecting in an interlocking manner with the corresponding ends of the wall sections 20 as described above.

Each corner section similarly includes a fill port 74 in the top side thereof for permitting access for fluids to be filled therethrough. The two sides of the corner section which are opposite the male and female connectors respectively both taper inwardly toward the top section 72 which is centrally aligned above the base. Each of these sides opposite the male and female connectors are similarly arranged to the sides 46 of the wall sections 20 by tapering inwardly across a main portion thereof and locating a respective handle 76 which is molded integrally therein similarly to the handles of the wall sections, but on adjacent sides of the corner sections.

Fasteners 78 are also provided in the top of each corner section 70 similarly to the fasteners of the wall sections for securing a cap member 80 thereon. The cap member 80 is generally L-shaped to match the configuration of the top section 72 of the corner section, but is generally U-shaped in cross section for conforming to the top and sides of the corner sections similarly to the cap member of the wall sections. Suitable clearance is provided between the cap member 80 and the top of the corner section 70 for accommodating the liner 24 therebetween. Slots 82 are again provided for receiving the fasteners 78 therein for securing the cap as described above with regard to the wall sections.

Figure 10:
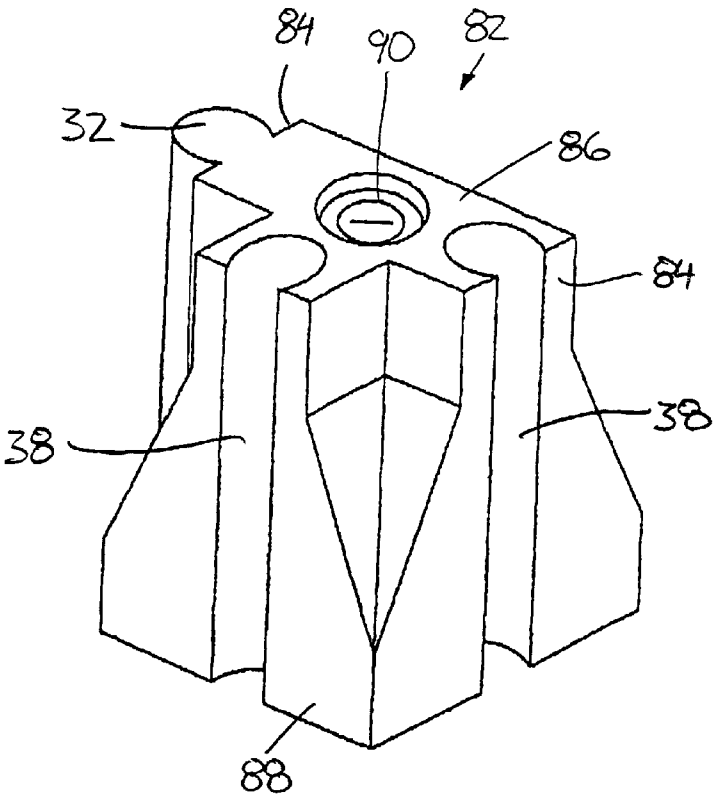
FIG. 10 is an isometric view of a 3-way section having a female configuration.
Figure 9:
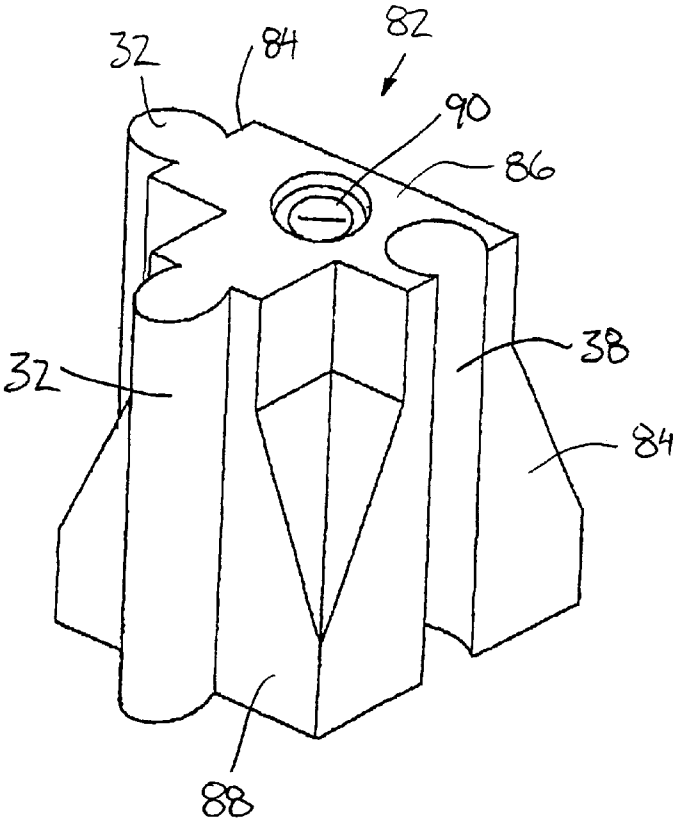
FIG. 9 is an isometric view of a 3-way section having a male configuration.
Figure 12:
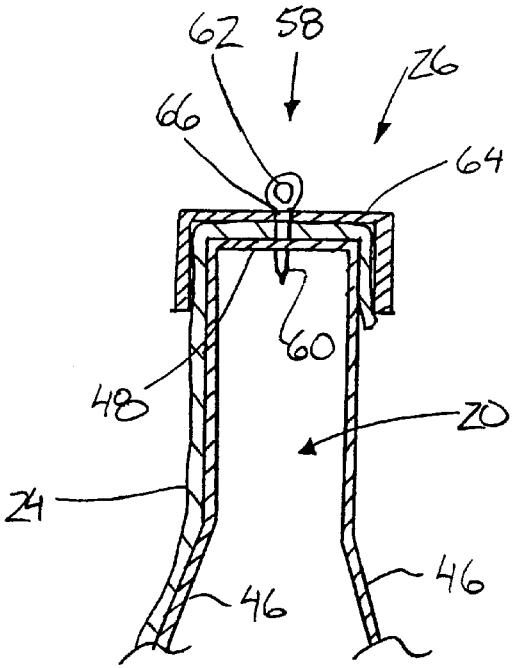
FIG. 12 is a sectional view of the liner shown secured to the top end of a wall section by a cap member.

As shown in FIG. 1, and in further detail in FIGS. 9 and 10 some of the corner sections 22 further comprise 3-way sections for connecting three wall sections 20 at right angles to one another in a T-shaped configuration. This is particularly useful for interconnecting intermediate wall sections with perimeter wall sections of the prescribed area 14. The 3-way section 82 includes a male configuration and a female configuration shown in FIGS. 9 and 10 respectively.

Both 3-way sections 82 have a square base which is equal in dimensions to the width of the base 44 of the wall sections. Both sections further include two flat opposite ends 84 which are vertically oriented for respectively mounting a male connector 32 and a female connector 38 opposite one another and spanning vertically the full length of the section thereon. The sides of the 3-way section 82 taper upwardly towards a narrow top section 86 which extends longitudinally between the opposed ends 84 of the 3-way section.

An intermediate side 88 between the opposite ends 84 also extends vertically upward from the base for mounting an additional connector thereon. The top section 86 is thus substantially T-shaped so as to span between the opposite ends 84 as well as having an intermediate section spanning to the intermediate side 88. Similarly to the previous sections, the 3-way section includes a fill port 90 to permit access to the interior of the section for filling. Also, suitable fasteners are provided for securing a cap member thereon which mates with the top section 86 of the 3-way section as in the previous sections. In the male configuration of the 3-way section 82 as shown in FIG. 9 the connector on the intermediate side 88 comprises a male connector 32, whereas in the female configuration of FIG. 10 there is provided a female connector 38 on the intermediate side 88 of the 3-way section.

Figure 11:
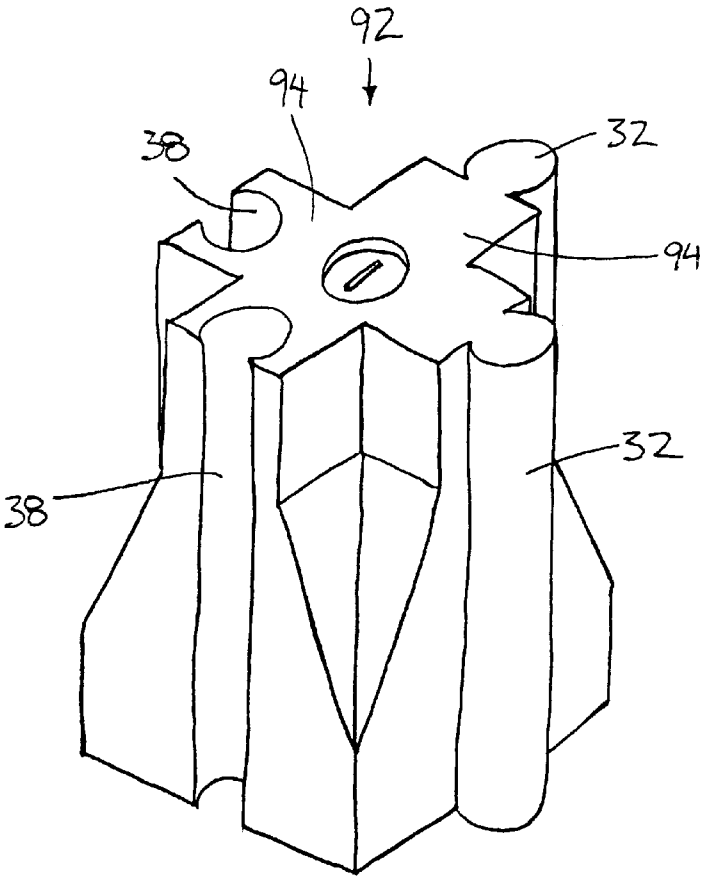
FIG. 11 is an isometric view of a 4-way section.

As shown in FIG. 1, and in further detail in FIG. 11, one of the connector sections 22 may comprise a 4-way section 92 which is arranged to connect four wall sections 20 at right angles to one another. The 4-way section 92 is particularly useful for connecting intersecting intermediate wall sections which subdivide the prescribed area 14 into plural zones 16. The 4-way section 92 has a square base similar to the other connector sections 22 which have dimensions approximately equal to the width of the base of the wall sections. The rectangular base tapers inwardly at the four corners thereof towards a narrow cross shaped top section 94. The cross shape of the top section 94 is defined by the intersection of two centrally located sections which span between opposing sides of the 4-way section 92. Two male connectors 32 are provided on respective adjacent sides of the 4-way section 92 with two female connectors 38 accordingly being located on respective adjacent sides opposite the male connectors. By having a male connector opposite each female connector, the 4-way section may be connected in line with the wall sections 20 as desired.

One of the connector sections 22 may further comprise a spacer section 96 which is similarly configured to the wall sections 20 by having a female connector at one end and a male connector at an opposite end thereof for connection inline with the wall sections as illustrated in FIG. 1. The spacer section 96 is particularly useful for mounting about the perimeter of a prescribed area in which an additional connector section 22 is mounted in an opposite wall structure formed by assembled wall sections 20 so that rectangular dimensions to the containment system surrounding the prescribed area may be preserved for proper fit between all of the components. The spacer section 96 includes respective sides 98 which taper inwardly towards a top end similarly to the sides of the wall sections so that the top of each spacer section 96 is generally aligned with the top of the wall sections 20 to permit a cap having a similar configuration to the wall sections to be secured thereon.

Both the spacer section 96 and the 4-way section 92 preferably include respective fill ports and fasteners for securing a mating cap member thereon for mounting of the liner to the connector sections similarly to the previous sections described above.

The liner 24 is formed of a durable and pliable material which spans the prescribed area as well as spanning the height of the wall sections 20 about a perimeter of each zone of the area 14. The liner is formed of a suitable material for containing liquid spilled within the prescribed area 14. When securing the liner to the walls sections 20 and the connector sections 22, the liner is laid over the top of each section before the appropriate cap member is secured thereon by punching holes in the liner for accommodating the fasteners therethrough so that the fasteners may then be inserted through the respective slots in the corresponding cap member at which point the cap member is secured in place by rotating the fasteners into the respective locked positions.

In practice, a prescribed area 14 is selected about one or more primary storage devices 12 which are desired to be protected against hazards resulting from accidental spilling. The wall sections 20 are then assembled about a perimeter of the selected area with suitable intermediate wall sections being provided when more than one primary storage device 12 is to be contained. Appropriate connector sections 22 are provided for interconnecting all of the wall sections 20 as shown in FIG. 1. The wall sections 20 are thus assembled both into continuous strips of interconnected wall sections as well as being connected to adjacent strips at right angles thereto by suitable connector sections 22. When intermediate walls are provided, suitable spacer sections 96 may be inserted within the opposite walls about the perimeter as required for maintaining the rectangular dimensions of the containment system about the prescribed area 14. Once the wall sections are connected, the liner 24 is laid across the floor of the area as well as over top of the wall sections 20 at the perimeter. Once the suitable cap members are mounted thereon using appropriate fasteners, or bolts if desired, the excess liner material outside of the prescribed area 14 may be trimmed away.

The generally U-shaped configuration of the cap members are particularly useful as they provide a close tolerance fit over top of the wall sections to firmly secure the liner not just at the fasteners but along the full length of each wall section. The width of the top section of each wall section is approximately 10 inches across while the internal dimensions of the cap member are preferably in the order of 11 inches across to accommodate ample space for a liner between the sides 46 of the wall sections and the depending side flanges of the cap member which are in the order of 4 inches in length. The cap members are preferably 72 inches in length for spanning substantially the full length of each wall section 20.

Use of varied designs of connector sections 22 enable multiple patterns of containment systems to be assembled. The 4-way section 92 is particularly useful for dividing a large area into four separate cells or zones. This allows for the storage of four different types of liquids that if mixed should a spill occur could result in a less than desirable concern. The 3-way sections 82 also permit division of a large prescribed rectangular containment area into two or three smaller cells or zones. In the event that a contaminated release occurs from one of the tanks or storage devices 12, cleanup is limited to a smaller area surrounding that single storage device. In addition to the environmental and safety issues provided by the 3-way and 4-way sections, these sections also allow the best possible use of available space while reducing the total number of sections required. The resulting reduction in sections being required increases the flexibility of the containment system while saving time and money for assembly of otherwise more elaborate containment systems.

In short the containment system 10 generally comprises a kit assembled from five differently configured sections. These sections include the wall sections which are straight and in the order of 6 feet in length, the corner sections which are square in the order of 2 feet by 2 feet in dimension, the spacer section which extends longitudinally in the order of 2 feet, the 3-way section also having a square base and the 4-way section which again has a square base. These pieces can be used to construct environmental containment systems of varying sizes for the storage and containment of hazardous fluids and materials that may spill or leak during plant or industrial work. The five different sections which define the containment system 10 can be assembled quickly indoors and out.

The 3-way and 4-way sections provide a unique system that allows containment systems to be divided into multiple larger or smaller cells for added flexibility while addressing safety and environmental issues at the same time.

As noted above all five sections are made from high density polyethylene which contains an ultraviolet protective additive and have an appropriate hardness so as to permit drop testing up to 40° C. below zero. All of these sections further include at least one male connector 32 and at least one female connector 38 for interconnection of adjacent sections in an interlocking configuration. Because the components of the containment system interlock together, the sections do not require filling with water or solids for stability. Once the system is assembled the components cannot be forced or pulled apart by an outward force from within the containment area.

The shape and height of the sections provide strength and versatility. The base of each section is 2 feet in width, tapering up to 10 inches in width at the top and spanning an overall height of 34 inches. The dyke like shape gives the system strength as in the event the system is filled with fluid there would not only be an outward force but a downward head pressure on the tapered and angled sides of the sections for added stability. The height of 34 inches allows for the 110% law for containment to be met in a smaller space for indoor applications where space is an issue.

As described above, once assembled the liner is installed to enclose the interior of the system and to ensure containment of hazardous fluids or materials that may spill into the containment area. The liner is laid or folded over the top of the wall sections and a square cap member of inverted U-shaped configuration fits over the liner and the top of the wall sections to be fastened in place by suitable bolts which hold the liner firmly in place.

The arrangement of the interlocking male and female connectors which slide together vertically ensures that the sections lock together like a puzzle without bolts and additional tools being required. The system can be placed on most flattened surfaces and later removed with zero disturbance to the ground.

While one embodiment of the present invention has been described in the foregoing, it is to be understood that other embodiments are possible within the scope of the invention. The invention is to be considered limited solely by the scope of the appended claims.

What is claimed is:

1. A fluid containment system comprising:

a plurality of wall sections, each spanning between a respective male end having a male connector projecting therefrom and a respective female end having a female connector within which the male connector of an adjacent wall section having a similar configuration is receivable therein;

a plurality of corner sections, each having a male connector and a female connector on respective adjacent sides of the corner section, the male connectors and the female connectors of the corner sections being configured similarly to the respective male and female connectors of the wall sections such that each wall section can be connected to either an adjacent one of the wall sections or an adjacent one of the corner sections so as to form a perimeter of wall and corner sections about a selected area;

each of the wall and corner sections comprising a hollow sealed container being wider at a base than at a top end and having an access port permitting the section to be filled with material;

the base of each corner section being square and having dimensions which are substantially equal to a width of the wall sections;

a liner arranged to span the selected area; and a mounting mechanism arranged to secure the liner to the wall sections about the perimeter of the selected area.

2. The fluid containment system according to claim 1 wherein each male connector includes a narrow neck portion and a main portion of increased dimension and each female connector includes a narrow mouth portion and a main portion of increased internal dimension for mating with the neck portion and main portion of a respective male connector in an interlocking configuration.

3. The fluid containment system according to claim 1 wherein there is provided a plurality of connector sections having respective male and female connectors so as to be arranged to connect the wall sections about the perimeter of the area as well as connecting intermediate wall sections between wall sections on opposing sides of the perimeter of the area for dividing the area into a plurality of zones each surrounded by the wall sections.

4. The fluid containment system according to claim 3 wherein each of the connector sections has a square base with dimensions approximately equal to a width of the wall sections.

5. The fluid containment system according to claim 3 wherein each connector section has a plurality of sides In which at least one of the sides includes a male connector projecting therefrom which is arranged to be received with the female connector of one of the well sections and at least one of the sides includes a female connector arranged to receive the male connector of one of the wall sections therein.

6. The fluid containment system according to claim 3 wherein each of the connector sections has a square base and at least one of the connector sections is a spacer section having a male connector and a female connector on opposite sides of the spacer section.

7. The fluid containment system according to claim 1 wherein there is provided a pair of handles on adjacent sides of each corner section opposite the male connector and female connector respectively.

8. The fluid containment system according to claim 1 wherein at least one of the corner sections comprises a 4-way section having a square base and having either a male connector or a female connector on each side thereof.

9. The fluid containment system according to claim 8 wherein the 4-way section includes two male connectors on adjacent sides and two female connectors on adjacent sides opposite the two male connectors respectively.

10. The fluid containment system according to claim 1 wherein at least one of the corner sections is a 3-way section having a male connector and a female connector on opposite sides and a second male connector on an intermediate side between the opposed male and female connectors.

11. The fluid containment system according to claim 1 wherein at least one of the corner sections is a 3-way section having a male connector and a female connector on opposite sides and a second female connector on an intermediate side between the opposed male and female connectors.

12. A fluid containment system comprising:

a plurality of wall sections, each spanning between a respective male end having a male connector projecting therefrom and a respective female end having a female connector within which the male connector of an adjacent wall section having a similar configuration is receivable therein;

a plurality of corner sections, each having a male connector and a female connector being configured similarly to the respective male and female connectors of the wall sections such that each wall section can be connected to either an adjacent one of the wall sections or an adjacent one of the corner sections so as to form a perimeter of wall and corner sections about a selected area;

a liner arranged to span the selected area; and a mounting mechanism arranged to secure the liner to the wall sections about the perimeter of the selected area;

the mounting mechanism comprising a plurality of cap members in the form of channels arranged to span a top side and extend downward along at least one side of the wall sections with the liner being received therebetween, the channels including apertures formed therein and a plurality of fasteners received through the apertures arranged to secure the cap members to the wall sections with the liner being secured between the cap members and the wall sections.

13. The fluid containment system according to claim 12 wherein the fasteners each include a threaded portion arranged for securement to the top side of the wall sections and a head portion which lies in a substantially common plane with a longitudinal axis of the threaded portion, the apertures in the cap members each comprising an elongate slot arranged to receive the head portion of the respective fastener therethrough in a first position of the fastener while restricting passage of the head portion therethrough In a second position of the fastener in which the head portion is rotated at right angles relative to the first portion.

14. The fluid containment system according to claim 12 wherein the channels are generally U-shaped in cross section for mating with the top side and extending downward along both sides of the respective wall sections.

15. The fluid containment system according to claim 14 wherein dimensions of the channels in relation to the top sides of the respective wall sections permits the liner to be snugly received between the wall sections and the cap members.

16. A fluid containment system for containing fluid in a selected area, the system comprising:

a plurality of wall sections, each spanning between a respective male end having a male connector projecting therefrom and a respective female end having a female connector within which the male connector of an adjacent wall section having a similar configuration is receivable therein;

a plurality of corner sections, each having a male connector and a female connector on respective adjacent sides of the corner section;

a plurality of connector sections, each having a male connector or a female connector on at least three respective sides;

each of the sections comprising a hollow sealed container having an access port permitting the section to be filled with material;

the male connectors and the female connectors of the corner sections and the connector sections being configured similarly to the respective male and female connectors of the wall sections;

the base of each corner section being square and having dimensions which are substantially equal to a width of the wall sections;

each wall section being connected to either an adjacent one of the wall sections or an adjacent one of the corner or connector sections so as to form a perimeter of sections about the selected area;

intermediate ones of the wall sections dividing the selected area into zones in which said intermediate ones of the wall sections are connected between connector sections connected on opposing sides of the perimeter of the selected area;

a liner arranged to span the selected area; and a mounting mechanism arranged to secure the liner to the wall sections about the perimeter of the selected area.

17. The fluid containment system according to claim 16 wherein at least one of the connector sections comprises a 4-way section having a square base and having either a male connector or a female connector on each side thereof.

18. The fluid containment system according to claim 16 wherein at least one of the connector sections is a 3-way section having a male connector and a female connector on opposite sides and a second male connector on an intermediate side between the opposed male and female connectors.

19. The fluid containment system according to claim 16 wherein at least one of the connector sections is a 3-way section having a male connector and a female connector on opposite sides and a second female connector on an intermediate side between the opposed male and female connectors.

20. The fluid containment system according to claim 16 wherein each of the corner and connector sections has a square base and at least one of the connector sections is a spacer section having a single male connector and a single female connector on opposite sides of the spacer section.

* * * * *